US006598573B2

(12) United States Patent
Kobayashi

(10) Patent No.: US 6,598,573 B2
(45) Date of Patent: Jul. 29, 2003

(54) FLYWHEEL MAGNETO GENERATOR

(75) Inventor: Tatsuo Kobayashi, Numazu (JP)

(73) Assignee: Kokusan Denki Co., Ltd., Numazu (JP)

( * ) Notice: Subject to any disclaimer, the term of this patent is extended or adjusted under 35 U.S.C. 154(b) by 0 days.

(21) Appl. No.: 10/155,676

(22) Filed: May 24, 2002

(65) Prior Publication Data

US 2002/0179069 A1 Dec. 5, 2002

(30) Foreign Application Priority Data

May 29, 2001 (JP) ..... 2001-159885

(51) Int. Cl.[7] ..... F02P 1/00
(52) U.S. Cl. ..... 123/149 D; 123/149 R
(58) Field of Search ..... 123/149 D, 143 R, 123/146.5 R, 149 R, 149 A

(56) References Cited

U.S. PATENT DOCUMENTS 4,603,664 A * 8/1986 Jackson ..... 123/149 D
4,980,592 A * 12/1990 Olmr et al. ..... 310/153
5,600,195 A * 2/1997 Welborn et al. ..... 310/153

FOREIGN PATENT DOCUMENTS

JP 11-136916 5/1999
JP 2000-032722 1/2000

* cited by examiner

*Primary Examiner*—Bibhu Mohanty
(74) *Attorney, Agent, or Firm*—Pearne & Gordon LLP

(57) ABSTRACT

A flywheel magneto generator comprising a flywheel driven by an internal combustion engine and having a permanent magnet, an ignition unit having an ignition coil and electronic devices mounted on a core having magnetic pole portions faced to an outer periphery of the flywheel, the flywheel having a plurality of blower blades provided on the outer faces of the bottom wall thereof and at lease one recess provided in the bottom wall portion of the flywheel and opened between the adjacent blower blades to both of the outer face of the bottom wall portion and the outer face of the peripheral wall portion of the flywheel whereby a cooling wind sent out outwardly in a diametrical direction by the blower blades when the flywheel rotates is blown through the recess against the ignition unit.

6 Claims, 2 Drawing Sheets

FLYWHEEL MAGNETO GENERATOR

TECHNICAL FIELD OF THE INVENTION

This invention relates to a flywheel magneto generator and more particularly to a flywheel magneto generator used for an internal combustion engine.

BACKGROUND OF THE INVENTION

There has been widely used as a generator for an internal combustion engine a flywheel magneto generator having an ignition unit provided on a side of a stator. Such a magneto generator is constructed as shown in FIGS. 3 and 4. The front face of the prior art flywheel magneto generator is shown in FIG. 3 and a cross section taken along the line IV—IV of FIG. 3 is shown in FIG. 4.

In these figures, a flywheel 1 is mounted on a rotational shaft of an internal combustion engine not shown and rotationally driven by the internal combustion engine. A permanent magnet 2 is provided in a groove in a peripheral wall 1*a* of the flywheel 1. A plurality of blower blades 1*c* are formed on an outer face of a bottom wall portion 1*b* of the flywheel 1 so as to stand in a line along the peripheral wall portion 1*a*. A boss 1*e* is formed at a central portion of the bottom wall portion 1*b* of the flywheel and mounted on the not shown rotational shaft of the internal combustion engine.

A stator core 5 is mounted on a member secured to an engine case or the like and has a pair of magnetic pole portions 5*a* and 5*b* disposed in a spaced manner in a peripheral direction of the flywheel 1 so that the magnetic pole portions 5*a* and 5*b* are faced to the outer face of the peripheral wall portion 1*a* of the flywheel 1 and to the permanent magnet 2.

An ignition unit 6 is mounted on the stator core 5. The ignition unit 6 comprises an ignition coil 6*a* having a primary coil 6*a*1 and a secondary coil 6*a*2, electronic devices (not shown) forming a part of an ignition system for the internal combustion engine together with the ignition coil 6 and a cover portion 6*c* to cover the ignition coil 6a and the electronic devices. The cover portion 6*c* is formed of a conventional insulating resin mold layer.

Of late, since the control of the ignition timing gets complicated because of attaining a purification of an exhaust gas and aiming at saving of a fuel cost, in many cases, a digital control system having a microcomputer used therein has been used as the ignition unit 6. Thus, in many cases, the electronic devices disposed within the cover of the ignition unit 6 include the microcomputer weak to heat as well as switch elements for controlling the primary current of the ignition coil.

Since, in this ignition unit, heat is generated from the ignition coil 6*a* and the electronic devices such as the switch elements for controlling the primary current of the ignition coil, a temperature of the ignition unit rises. Thus, in order to protect the electronic devices, the ignition unit 6 should be cooled and to this end, the blower blades 1*c*, 1*c*, - - - are provided on the bottom wall portion of the flywheel.

In the magneto generator of FIGS. 3 and 4, there is generated a flow of cooling wind sent out outwardly in the diametrical direction of the flywheel 1 by the blower blades 1*c*, 1*c*, - - - when the flywheel 1 rotates in a direction indicated by an arrow of FIG. 3 with the rotation of the engine. This cooling wind flows outwardly in the diametrical direction along the outer face of the bottom wall portion as indicated by an arrow W' of FIG. 4, the most of the cooling wind flows while going past by the ignition unit 6 without contacting it directly. Thus, there arises a problem that it is hard to cool the ignition unit 6 effectively.

Especially, in the case where the electronic devices forming the ignition unit 6 include the microcomputer weak to heat, it is required that the temperature of the ignition unit is maintained at a value equal to or less than a limit value in comparison with the prior art ignition unit, but it is hard that the prior art flywheel magneto generator complies with such a request.

SUMMARY OF THE INVENTION

Accordingly, it is a principal object of the invention to provide a flywheel magneto generator adapted to improve a cooling effect of an ignition unit by increasing the amount of a cooling wind contacting the ignition unit.

A magneto generator of the present invention comprises a cup-shaped flywheel having a peripheral wall portion and a bottom wall portion and mounted on a rotational shaft of an internal combustion engine and driven by the internal combustion engine with a plurality of blower blades provided on an outer face of the bottom wall portion so as to be arranged along the peripheral wall portion, a permanent magnet provided in a groove in an outer face side of the peripheral wall portion of the flywheel, a stator core having magnetic pole portions disposed in a spaced manner in the peripheral direction of the flywheel so that the magnetic pole portions are faced to the peripheral outer face of the flywheel and the permanent magnet and an ignition unit secured to the stator core and having and ignition coil wound on the stator core, electronic devices forming at least a part of an ignition system for the internal combustion engine together with the ignition coil and a cover portion to cover the ignition coil and the electronic devices. In the invention, the flywheel comprises at least one recess provided on the bottom wall portion thereof an outer face of the peripheral wall of the flywheel.

With the recess provided in the bottom wall portion of the flywheel opening between the adjacent blower blades and extending to the outer face of the peripheral wall portion of the flywheel, respectively as aforementioned, the inside of the recess gets a negative pressure when the flywheel rotates. Thus, the flow of the cooling wind generated by the blower blades is drawn in the recess. The thus drawn cooling wind is drawn closer to the bottom portion of the recess (to the central part of the ignition unit) and sent out toward the ignition unit by means of centrifugal force generated with the rotation of the flywheel whereby the amount of the wind blown directly against the ignition unit increases. Thus, the ignition unit can be effectively cooled and therefore in the case where the temperature of the ignition unit should be reduced to the lower value such as the case where the microcomputer is provided in the ignition unit, the generator can comply with such a request.

The recess may be preferably provided so that the diametrical direction opening is faced to at least a part of the magnetic pole portions of the stator core.

With the recess provided in this manner, the amount of the cooling wind blown directly against the stator core increases and therefore cooling of the stator core is promoted. This increases the difference of the temperature between the ignition unit and the stator core. Thus, the heat conduction from the ignition unit to the stator core can be made better and cooling of the ignition unit can be more effectively made on the synergistic effect of the heat exchange performed between the outer surface of the ignition unit and the cooling wind and the heat dissipation performed through the stator core from the ignition unit.

BRIEF DESCRIPTION OF THE DRAWINGS

The above and other objects and features of the invention will be apparent from the detailed description of the preferred embodiment of the invention, which is described and illustrated with reference to the accompanying drawings, in which.

DETAILED DESCRIPTION OF PREFERRED EMBODIMENTS

Figure 1:
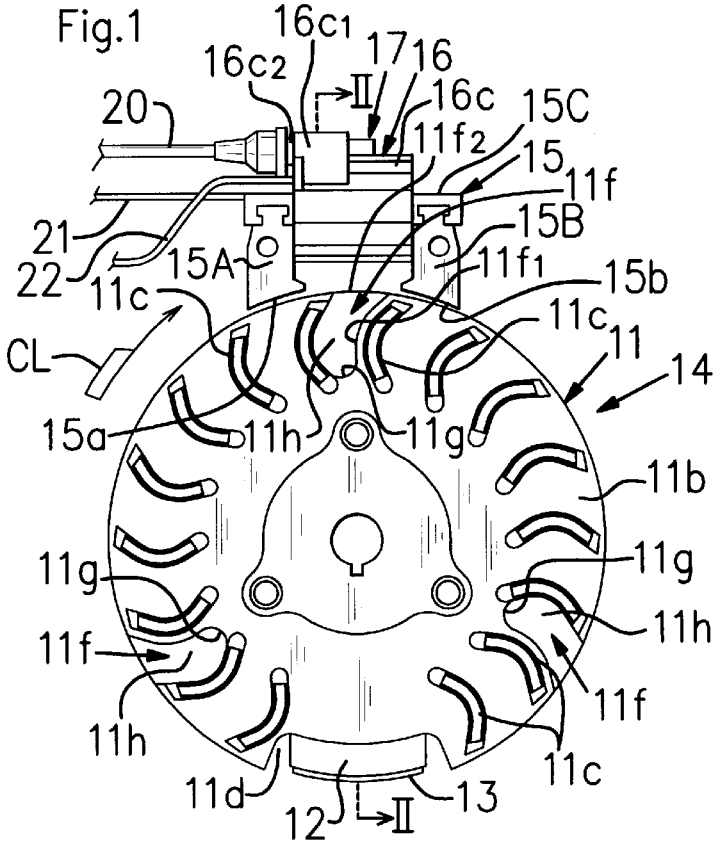
FIG. 1 is a front view of a flywheel magneto generator constructed in accordance with one embodiment of the invention.
Figure 2:
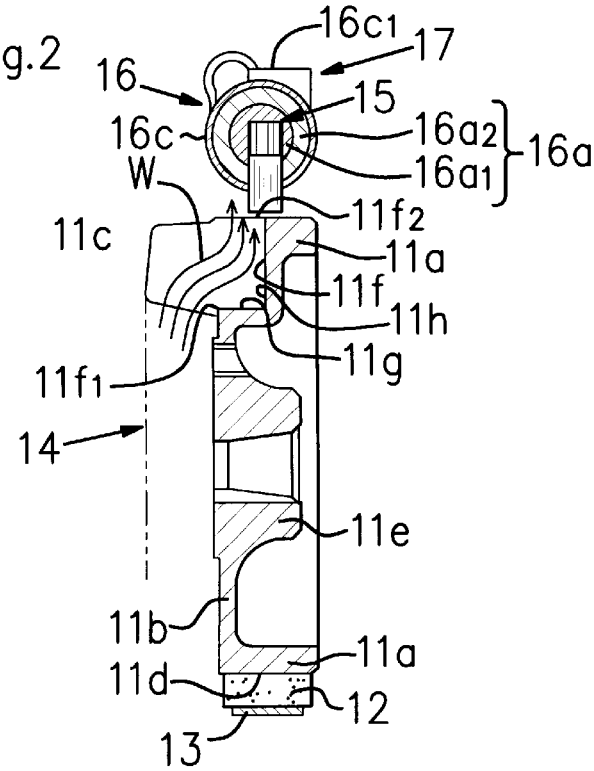
FIG. 2 is a cross sectional view of the generator of FIG. 1 taken along the line II—II line of FIG. 1.
Figure 3:
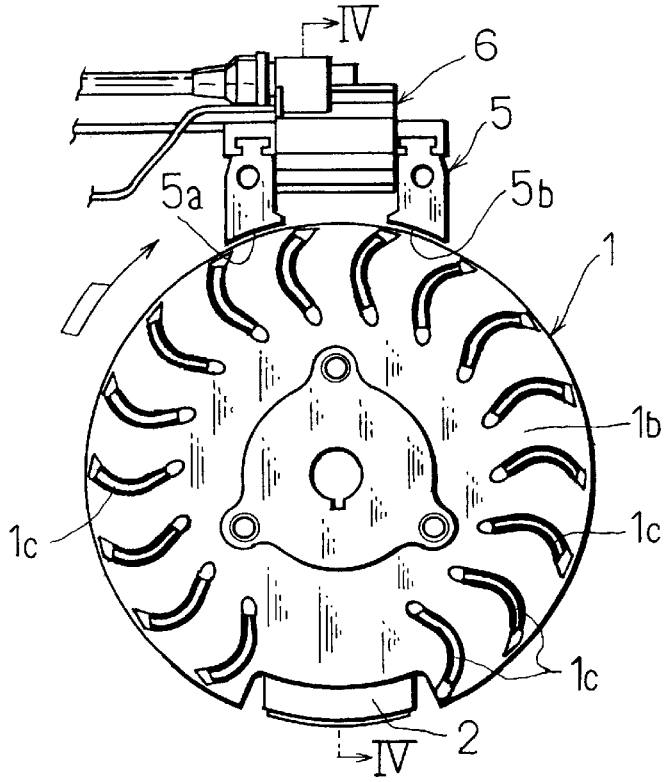
Fig.3 Prior Art
FIG. 3 is a front view of a prior art flywheel magneto generator.
Figure 4:
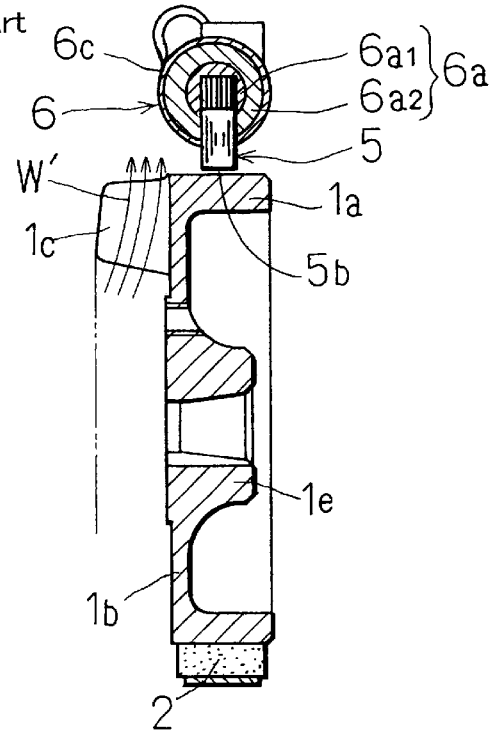
Fig.4 Prior Art
FIG. 4, is a cross sectional view of the generator of FIG. 3 taken along the line IV—IV line of FIG. 3.

A preferred embodiment of the invention is shown in FIGS. 1 and 2. A flywheel designated by the numeral 11 in these figures is mounted on a not shown rotational shaft of an internal combustion engine and driven by the internal combustion engine in a direction indicated by an arrow CL of FIG. 1. The flywheel 11 is formed of a ferromagnetic material such as an iron and generally shaped in the form of a cup having a peripheral wall portion 11*a* and a bottom wall portion 11*b*. A plurality of blower blades 11*c* are formed on an outer face of the bottom wall portion 11*b* of the flywheel so as to be arranged along the peripheral wall portion 11*a* of the flywheel. Each of the blower blades 11*c* is formed so as to have a convex arc toward the rear side of the rotational direction whereby an air stream is generated by the blower blades 11*c*, 11*c*, - - - from the inside of the flywheel to the outside thereof in the diametrical direction when the flywheel 11 rotates.

A groove 11*d* is formed in an outer face of the peripheral wall portion 11*a* of the flywheel 11 and a permanent magnet 12 is disposed on a bottom of the groove 11. A pole piece 13 is disposed on an outside magnetic pole face of the magnet 12. The pole piece 13 and the magnet 12 are tightened by not shown screws to the peripheral wall portion 11*a* of the flywheel 11. The flywheel 11, the permanent magnet 12 and the pole piece 13 form a flywheel magnet rotor 14.

At the center of the bottom wall portion 11*b* of the flywheel 11, it is formed a boss 11*e* having a tapered hole provided at an axis thereof and secured to a leading end of the not shown rotational shaft of the internal combustion engine.

In the present invention, each recess 11*f* has a back wall 11*g* which intersects the bottom wall portion 11*b*. A recessed floor Portion 11*h* is provided between adjacent blower blades from the back wall 11*g* to an intersection with the outer face of the peripheral wall portion 11*a*. At least one recess 11*f* may be provided, but in the illustrated embodiment, three recesses 11*f* are provided at angular intervals of 120 degree.

On the side of the peripheral face of the flywheel, it is disposed a stator 17 comprising a stator core 15 and an ignition unit 16 mounted on the stator core 15.

The stator core 15 is U-shaped by an I-shaped coil winding portion 15C and leg portions 15A and 15B having rear ends connected to both ends of the coil winding portion 15C and pole pieces 15*a* and 15*b* are formed at leading ends of the leg portions 15A and 15B, respectively.

The ignition unit 16 mounted on the stator core 15 comprises an ignition coil 16*a* having a primary coil 16*a*1 and a secondary coil 16*a*2, both of which are wound on the coil winding portion 15C of the stator core 15, electronic devices (not shown) forming at least a part of an ignition system for the internal combustion engine together with the ignition coil 16*a* and a cover portion 16*c* provided so as to cover the ignition coil 16*a* and the electronic devices. In the illustrated embodiment, the cover portion 16*c* is formed of an insulating resin mold layer. The electronic devices forming the ignition system together with the ignition coil are disposed within a square protrusion 16*c*1 that is formed on the upper side of the cover portion 16*c*. The electronic devices include a chip of a microcomputer to control an ignition timing. At an end of the cover portion 16*c* of the ignition unit 16, it is formed a high voltage code connection portion 16*c*2 having a high voltage terminal connected to a non-grounded terminal of the secondary coil of the ignition coil. A high voltage code 20 connected to the high voltage code connection portion 16*c*2 connects the high voltage terminal to an ignition plug, which is in turn provided in each of cylinders of the not shown internal combustion engine.

In the illustrated embodiment, from the end of the cover portion 16*c* of the ignition unit 16, lead wires 21 and 22 are drawn out, which should be connected to a pulser to detect a crank angle information used for controlling the ignition timing and a sensor to detect various control conditions.

The illustrated stator 17 is disposed so that the magnetic pole portions 15*a* and 15*b* at both ends of the stator core 15 are arranged in a spaced manner in the peripheral direction of the flywheel and so that the magnetic pole portions 15*a* and 15*b* are faced through a gap to the peripheral outer face of the flywheel 11 and the permanent magnet 12 and secured by an appropriate securing means such as a screw to an attachment portion on the member attached to a not shown engine case or the like.

In the present embodiment, as shown in FIG. 1, the inner faces of the recesses of faced to each other in the rotational direction of the flywheel 11 are formed so as to have are arc curvature along the blower blades 11*c* and 11*c* on both sides of the recesses 11*f*. Also, as shown in FIG. 2, the depth of the recesses 11*f* is so set that a diametrical opening 11*f*2 of each of the recesses 11*f* is faced to at least a portion of each of the magnetic pole portion 15*a* and 15*b* of the stator core 15 when the magnetic pole portion 15*a* and 15*b* of the stator core are located while the flywheel rotates.

In the magneto generator shown in FIGS. 1 and 2, as the flywheel 11 rotates, a voltage is induced across the primary coil of the ignition coil 16*a* of the ignition unit 16. The electronic devices forming the ignition unit form a control circuit to control the primary current through the ignition coil 16*a* with the voltage across the primary coil used as the power source voltage. The control circuit is of a current interruption type circuit to induce a high voltage across the secondary coil of the ignition coil 16*a* by interrupting the current flowing through the primary coil of the ignition coil 16*a* at the ignition timing, for example. Since the high voltage is applied through the high voltage code 20 across the ignition plug in each of the cylinders of the internal combustion engine, a spark discharge is generated across the ignition plug to ignite the engine.

As the recesses 11*f* opened between the adjacent blower blades and to the outer face of the peripheral wall portion of the flywheel 11 are provided in the bottom wall portion of the flywheel 11 as aforementioned, the inside of the recesses 11*f* get a negative pressure when the flywheel rotates. Thus, the flow of the cooling wind generated by the blower blades 11*c*, 11*c*, - - - is drawn in the recesses 11*f* as indicated by the arrow W in FIG. 2. The thus drawn cooling wind is drawn closer to the bottom portion of the recesses 11*f* (to the central part of the ignition unit 17) and sent out toward the ignition unit 16 by means of centrifugal force generated with the rotation of the flywheel 11. Thus, the amount of the wind blown directly against the ignition unit 16 increases. Therefore, the ignition unit 16 can be effectively cooled, and as a result, in the case where the temperature of the ignition unit 16 should be reduced to the lower value such as the case where the microcomputer is provided in the ignition unit 16, the generator can comply with such a request.

Especially, as the recesses 11*f* are provided so that the diametrical direction opening 11*f*2 is faced to at least a part of the magnetic pole portions of the stator core 15 as in the present embodiment, the amount of the cooling wind blown directly against the stator core 15 increases and therefore cooling of the stator core 15 is promoted. This increases the difference of the temperature between the ignition unit 16 and the stator core 15. Thus, the heat conduction from the ignition unit 16 to the stator core 15 can be made better and cooling of the ignition unit 16 can be more effectively made by the synergistic effect of the heat exchange performed between the outer surface of the ignition unit 16 and the cooling wind and the heat dissipation performed through the stator core 15 from the ignition unit 16.

Although the number of the recesses may be arbitrary, the number of the recesses 11*f* and the position thereof may be preferably set so as not to adversely affect the magnetic passage of the magnetic flux flowing from the permanent magnet 12 through the core 15 of the ignition unit 16 and the peripheral wall portion of the flywheel 11.

Although one preferred embodiment of the invention has been described and illustrated with reference to the accompanying drawings, it will be understood by those skilled in the art that it is by way of example, and that various changes and modifications may be made without departing from the spirit and scope of the invention, which is defined only to the appended claims.

What is claimed is:

1. A flywheel magneto generator used for an internal combustion engine comprising a cup-shaped flywheel having a peripheral wall portion and a bottom wall portion and mounted on a rotational shaft of said internal combustion engine and driven by said internal combustion engine with a plurality of blower blades provided on an outer face of said bottom wall portion so as to be arranged along said peripheral wall portion, a permanent magnet provided in a groove in an outer face side of said peripheral wall portion of said flywheel, a stator core having magnetic pole portions disposed in a spaced manner in the peripheral direction of said flywheel so as to be faced to said peripheral face of said flywheel and said permanent magnet and an ignition unit secured to said stator core and having an ignition coil wound on said stator core, electronic devices forming at least a part of an ignition system for said internal combustion engine together with said ignition coil and a cover portion to cover said ignition coil and said electronic devices, said flywheel comprising at lease one recess provided in said bottom wall portion thereof and having an axial direction opening to be opened to an outer face of said bottom wall portion of said flywheel between said adjacent blower blades and a diametrical direction opening to be opened to an outer face of said peripheral wall portion of said flywheel.

2. A flywheel magneto generator as set forth in claim 1 and wherein each of said blower blades is formed so as to have a convex arc toward a rear side of the rotational direction of said flywheel and wherein inner faces of said recess faced to each other in the rotational direction of said flywheel are formed so as to have an arc curvature along said blower blades.

3. A flywheel magneto generator as set forth in claim 1 and wherein a depth of said recess is so set that at least a portion of each of said magnetic pole portions of said stator core is faced to a part of said diametrical direction opening of said recess.

4. A flywheel magneto generator as set forth in claim 1 and wherein a plurality of said recesses are provided in a spaced manner in the peripheral direction of said flywheel.

5. A flywheel magneto generator used for an internal combustion engine comprising a cup-shaped flywheel having a peripheral wall portion and a bottom wall portion and mounted on a rotational shaft of said internal combustion engine and driven by said internal combustion engine with a plurality of blower blades provided on an outer face of said bottom wall portion so as to be arranged along said peripheral wall portion, a permanent magnet provided in a groove on an outer face side of said peripheral wall portion of said flywheel, a stator core having magnetic pole portions disposed in a spaced manner in the peripheral direction of said flywheel so as to be faced to said peripheral face of said flywheel and said permanent magnet and an ignition unit secured to said stator core and having an ignition coil wound on said stator core, electronic devices forming at least a part of an ignition system for said internal combustion engine together with said ignition coil and a cover portion to cover said ignition coil and said electronic devices, said flywheel comprising at lease one recess provided in said bottom wall portion thereof and having an axial direction opening to be opened to an outer face of said bottom wall portion of said flywheel between said adjacent blower blades and a diametrical direction opening to be opened to an outer face of said peripheral wall portion of said flywheel, each of said blower blades being formed so as to have a convex arc toward a rear side of the rotational direction of said flywheel, inner faces of said recess faced to each other in the rotational direction of said flywheel being formed so as to have an arc curvature along said blower blades, and a depth of said recess being so set that at least a portion of each of said magnetic pole portions of said stator core is faced to a part of said diametrical direction opening of said recess.

6. A flywheel magneto generator as set forth in claim 5 and wherein a plurality of said recesses are provided in a spaced manner in the peripheral direction of said flywheel.

* * * * *

UNITED STATES PATENT AND TRADEMARK OFFICE

CERTIFICATE OF CORRECTION

PATENT NO. : 6,598,573 B2
DATED : July 29, 2003
INVENTOR(S) : Tatsuo Kobayashi

It is certified that error appears in the above-identified patent and that said Letters Patent is hereby corrected as shown below:

Column 4,
Line 41, delete "recesses of" and insert -- recesses 11f --.
Line 48, after "when" insert -- each of the recesses 11f passes the position where --.

Column 5, lines 45-60 through Column 6, lines 1-8,
Claim 1, should be corrected as follows:

A flywheel magneto generator used for an internal combustion engine comprising a cup-shaped flywheel having a peripheral wall portion and a bottom wall portion and mounted on a rotational shaft of said internal combustion engine and driven by said internal combustion engine with a plurality of blower blades provided on an outer face of said bottom wall portion so as to be arranged along said peripheral wall portion, a permanent magnet provided in a groove in an outer face side of said peripheral wall portion of said flywheel, a stator core having magnetic pole portions disposed in a spaced manner in the peripheral direction of said flywheel so as to be faced to said peripheral face of said flywheel and said permanent magnet and an ignition unit secured to said stator core and having an ignition coil wound on said stator core, electronic devices forming at least a part of an ignition system for said internal combustion engine together with said ignition coil and a cover portion to cover said ignition coil and said electronic devices, said flywheel comprising at least one recess provided in said bottom wall portion thereof, each said recess being defined by a back wall intersecting said bottom wall portion and a recessed floor portion between adjacent blower blades, said recessed floor portions extending from said back wall to an intersection with an outer face of said peripheral wall portion of said flywheel.

Column 6,
Lines 9-15, claim 2 should be corrected as follows:

A flywheel magneto generator as set forth in claim 1 and wherein each of said blower blades is formed so as to have a convex arc toward a rear side of the rotational direction of said flywheel and wherein inner faces of said recess facing each other in the rotational direction of said flywheel and are formed so as to have an arc curvature along said blower blades.

Lines 16-20, claim 3 should be corrected as follows:

A flywheel magneto generator as set forth in claim 1 and wherein a depth of said recess is so set that at least a portion of each of said magnetic pole portions of said stator core faces said intersection with said outer face.

Lines 24-55, claim 5 should be corrected as follows:

A flywheel magneto generator used for an internal combustion engine comprising a cup-shaped flywheel having a peripheral wall portion and a bottom wall portion and mounted on a rotational shaft of said internal combustion engine and driven by said internal combustion engine with a plurality of blower blades provided on an outer face of said bottom wall portion so as to be arranged along said peripheral wall portion, a permanent magnet provided in a groove on an outer face side of said peripheral wall portion of said flywheel, a stator core having magnetic pole portions

UNITED STATES PATENT AND TRADEMARK OFFICE

CERTIFICATE OF CORRECTION

PATENT NO. : 6,598,573 B2
DATED : July 29, 2003
INVENTOR(S) : Tatsuo Kobayashi

It is certified that error appears in the above-identified patent and that said Letters Patent is hereby corrected as shown below:

Column 6 (cont'd),
disposed in a spaced manner in the peripheral direction of said flywheel so as to be faced to said peripheral face of said flywheel and said permanent magnet and an ignition unit secured to said stator core and having an ignition coil wound on said stator core, electronic devices forming at least part of an ignition system for said internal combustion engine together with said ignition coil and a cover portion to cover said ignition coil and said electronic devices, said flywheel comprising at least one recess provided in said bottom wall portion thereof, each said recess being defined by a back wall intersecting said bottom wall portion and a recessed floor portion between adjacent blower blades, said recessed floor portions extending from said back wall to an intersection with an outer face of said peripheral wall portion of said flywheel, each of said blower blades being formed so as to have a convex arc toward a rear side of the rotational direction of said flywheel, each of said blower blades being formed so as to have a convex arc toward a rear side of the rotational direction of said flywheel, inner faces of said recess facing each other in the rotational direction of said flywheel and are formed so as to have an arc curvature along said blower blades, and a depth of said recess being so set that at least a portion of each of said magnetic pole portions of said stator core faces said intersection with said outer face.

Signed and Sealed this

Fourth Day of November, 2003

JAMES E. ROGAN
*Director of the United States Patent and Trademark Office*